US005172459A

United States Patent [19]

Goineau

[11] Patent Number: 5,172,459

[45] Date of Patent: Dec. 22, 1992

[54] MULTI-PLY AIR TEXTURED YARN

[75] Inventor: Andre M. Goineau, Spartanburg, S.C.

[73] Assignee: Milliken Research Corporation, Spartanburg, S.C.

[21] Appl. No.: 643,561

[22] Filed: Dec. 21, 1990

Related U.S. Application Data

[62] Division of Ser. No. 501,279, Mar. 29, 1990.

[51] Int. Cl.[5] ..... D02J 1/22; D02G 1/16

[52] U.S. Cl. ..... 28/240; 28/273

[58] Field of Search ..... 28/271, 272, 273, 240, 28/241; 57/287

[56] References Cited

U.S. PATENT DOCUMENTS

| | | | |
|---|---|---|---|
| 3,328,863 | 7/1967 | Cobb et al. | 28/273 |
| 3,831,231 | 8/1974 | Binford et al. | 28/271 X |
| 4,025,595 | 5/1977 | Mirhej | 28/271 X |
| 4,059,873 | 11/1977 | Nelson | 28/271 |
| 4,280,261 | 7/1981 | Nelson | 28/271 |
| 4,319,447 | 3/1982 | Barron | 28/271 X |
| 4,341,063 | 7/1982 | Southerlin et al. | 57/6 |
| 4,343,146 | 8/1982 | Nelson | 28/271 X |
| 4,497,099 | 2/1985 | Scott | 28/220 |
| 4,571,793 | 2/1986 | Price | 28/220 |
| 4,736,500 | 4/1988 | Goineau | 28/220 |
| 4,815,500 | 3/1989 | Goineau | 139/21 |
| 4,851,643 | 7/1989 | Goineau | 219/388 |
| 4,896,407 | 1/1990 | Haynes | 28/271 X |

FOREIGN PATENT DOCUMENTS

| | | | |
|---|---|---|---|
| 197803 | 3/1978 | Canada . | |
| 50-26661 | 9/1975 | Japan | 28/271 |
| 5943140 | 3/1984 | Japan . | |
| 1070063 | 4/1986 | Japan | 28/271 |
| 6503706 | 3/1965 | Netherlands | 28/271 |
| 799185 | 8/1958 | United Kingdom . | |

*Primary Examiner*—Andrew M. Falik
*Assistant Examiner*—Bibhu Mohanty
*Attorney, Agent, or Firm*—Earle R. Marden; H. William Petry

[57] ABSTRACT

A multi-ply continuous filament air textured yarn and method to produce same by combining a plurality of POY yarns in a nip and supplying them to a heated draw block to provide two stages of drawing. The drawn yarn is then heat set and supplied to an air nozzle to texture the yarn.

1 Claim, 1 Drawing Sheet

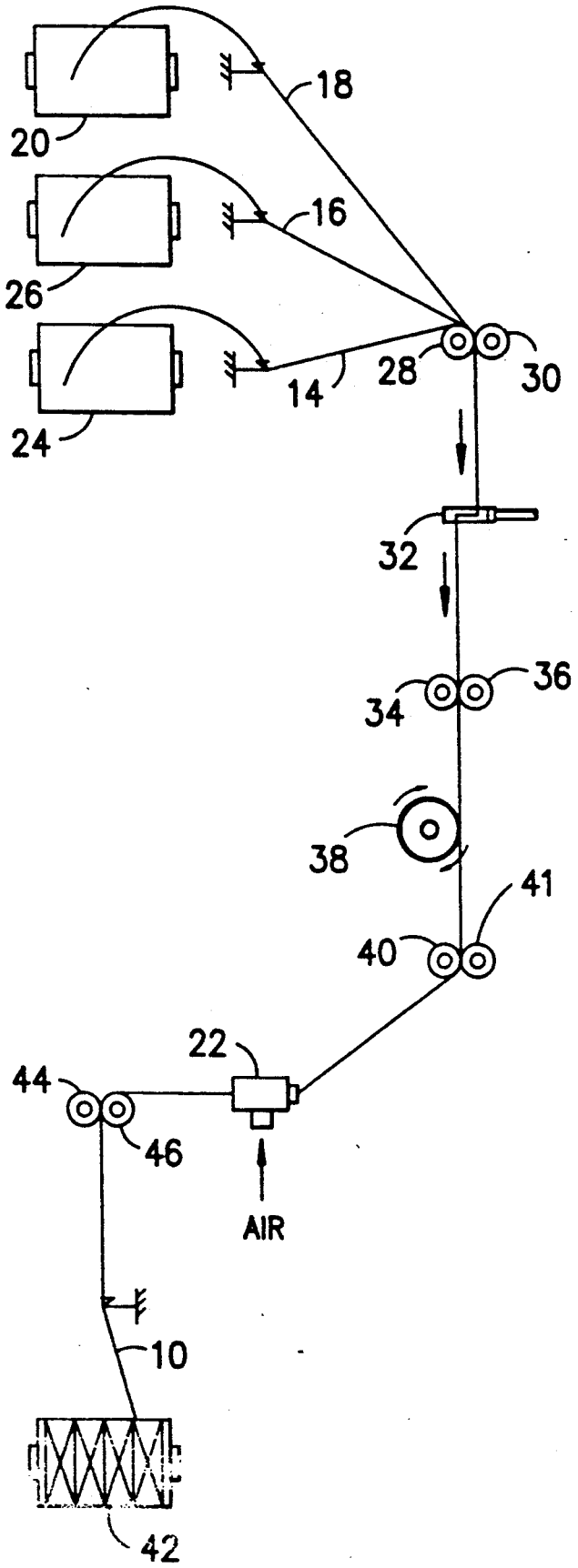
18
20
16
26
28
30
14
24
32
36
34
38
41
40
22
44
46
AIR
10
42

MULTI-PLY AIR TEXTURED YARN

This is a division of application Ser. No. 501,279 filed Mar. 23, 1990 for MULTIPLY AIR TEXTURED YARN.

This invention relates to a multi-ply air textured continuous filament yarn for use particularly in a substrate for an abrasive which provides greater strength and stability to the fabric. The yarn is composed of a plurality of POY yarns merged, drawn and heat set prior to air texturing.

In the abrasive industry, "abrasive on a substrate" is the collective designation for numerous products consisting of a flexible substrate coated with abrasive grains. It corresponds to the designation "coated abrasives" used is most English-speaking parts of the world.

"Abrasive on a substrate" utilizing polyester yarns have been known for some time. For example, in Canadian Pat. No. 676,601, coated abrasives are described, wherein the substrate consists of a woven fabric. Such a woven fabric may consist of yarns of a varied number of polymers, including polypropylene, polyethylene and polyesters.

While the Canadian reference No. 676,601 mentions that woven substrate fabrics can be made of filament yarns, preference is given to polyester stable fibers, since fabrics of this material are better able to absorb enough abrasive grain and to provide adequate adhesion of the grain to the substrate. When using yarns of smooth continuous polyester filaments, one does indeed obtain relatively uniform substrates, but the adhesion of the grain in the substrate leaves much to be desired. Efforts have been made, therefore, to obtain a more staple fiber-like nature in filament yarns by modifying the structure thereof to obtain the advantage of continuous filament yarns in the manufacture of substrate with advantages possessed by stable fibers.

In German Pat. No 3,218,441, various kinds of filament yarns are referred to which may serve in the manufacture of a supporting fabric used in a coated abrasives substrate. The yarns may consist of filaments having a non-circular, e.g., a triangular, cross section. Reference is also made to fibers having lateral extensions along the length of the fiber as spacing elements without explaining how those lateral extensions are to be shaped in the fiber. Reference is also made to crimped polyester filament yarns without indicating processing conditions on how to obtain the crimp for satisfactory performance as a substrate.

As a consequence, until now, there has been an unfulfilled demand for a textured polyester filament yarn which can be used advantageously in the manufacture of abrasives in a substrate in such a manner that it is possible to obtain abrasive having a uniform and clean surface and a long running time; which further will not rapidly lose their binding agent grain layer during grinding; and which, beyond that, possess a high level of adhesion between substrate and abrasive grain, even in the range of fine grains; and also exhibits a substrate which exhibits a good absorbency for the binding agent used in coated abrasives.

It is, therefore, a goal of the present invention to utilize textured polyester filament yarns accordingly described herein the manufacture abrasives on a substrate which do not possess the mentioned disadvantages above for filament yarn, and, on the other hand excel in the advantages above listed for staple fiber yarns.

Other objects of the invention will become readily apparent as the specification proceeds to describe the invention with reference to the accompanying drawing which is a schematic representation of one method of manufacturing the novel multi-ply yarn.

Looking now to the drawing the method to produce the novel multi-ply yarn 10 for use in the production of substrates for coated abrasive fabric is schematically represented. The yarn 10 in the preferred form of the invention is a three-ply, b 150 denier, 34 filament polyester air textured yarn which is produced from three yarn packages 20, 24 and 26 of DuPont 265/34-56T POY filament polyester yarn. In the preferred form of the invention the yarn 10 is produced from three POY yarns but can be produced by the merger of three of more POY yarns depending on the end use of the produced yarn.

The yarns 14, 16 and 18 drawn off the packages 24, 26 and 20, respectively, are merged to gather in the nip of feed rolls 28, 30 and delivered at a rate of 233 inches/minute to the draw block 32 heated to a temperature of about 120° C. Since the rolls 34, 36 are delivering yarn at a rate of 443 inches/minute the draw block 32 provides two stages of drawing as described in U.S. Pat. No. 4,736,500 with a draw ratio of 1.9. From the rolls 34, 36 the drawn is wrapped around the pin 38, heated to a temperature of about 160° C., and allowed to relax and be heat set since the rolls 40, 41 are delivering yarn at a rate of 428 inches/minute. From the rolls 40, 41 the yarn 10 passes through a conventional air texturing jet 22, operating with air at a pressure of 140 p.s.i. wherein it is air textured. From the air texturing jet 22, the yarn 10 is delivered to the take-up package 42 by the rolls 44, 46 driven at a suitable desired speed.

The three-ply air textured polyester yarn 10 on the package is preferably used to form a substrate fabric for use in coated abrasive fabric. The substrate fabric is preferably a woven produce but could be a nonwoven or knitted product.

"Substrates" within the context of this invention is understood to include flat, shaped articles such as nonwovens, woven or knitted fabrics, and the like which make use of appropriate adhesive agents. If required, additional customary additives can be coated or loaded with customary abrasives herein. The substrates can.be made up in the form of strips, ribbons, mats, etc., and they also consist of specially made up flat shaped articles such as discs or the like. Fabrics can be constructed in customary weaves, and the weight of the fabrics may vary, for example, between 150 to 500 grams per square meter. The same or different deniers of yarns may be used in the warp and filling of woven fabrics.

The substrate may consist of a single flap shaped textile article. It is also possible to combine two or more kinds of flat shaped articles in the manufacture thereof. In one embodiment, the yarns in the substrate may be in the form of a pile material. By pile material, it is meant any textile fabric which the yarns, due to the manufacturing process, form projections, e.g. tufts. The piles may be open or closed.

The substrates manufactured in accordance with the invention herein have a smooth surface noticeable in the finished abrasive, and have a long running time and operation. Results generally obtained only with staple fiber yarns may be obtained through this particular invention, while still retaining the advantages of continuous filament yarn manufacture. The special structure of the yarns permits the substrate manufactured therewith to be very absorptive of binding agents, permitting the letter to penetrate into the interior of the substrate, guaranteeing a good adhesion of the grain thereto. Substrates manufactured in accordance with the invention herein exhibit excellent mechanical characteristics—in particular, strength, tear resistance, and low relative elongation, especially in the case of woven fabrics. Special advantages of cleanliness and surface adhesion are obtained with fine grain abrasives utilizing the substrate described herein and may be used in wet as well as dry grinding processes.

Although the preferred embodiment of the invention has been described specifically, it is contemplated many changes may be made without departing from the scope or spirit of the invention and it is desired that the invention be limited only by the claims.

I claim:

1. The method of producing a multi-ply yarn comprising the steps of: supplying at least three separate partially oriented synthetic filament yarns, merging the three supplied yarns, drawing the supplied merged yarns twice each at the same draw ratio, supplying the twice drawn yarns into an air jet, supplying air under pressure into said air jet, commingling and air texturing the supplied yarns in the air jet and taking up the commingled and air textured yarn.

* * * * *